US009537276B1

(12) United States Patent
Cai et al.

(10) Patent No.: US 9,537,276 B1
(45) Date of Patent: Jan. 3, 2017

(54) POWER ADAPTER WITH REPLACEABLE PLUG STRUCTURE

(71) Applicant: ASIAN POWER DEVICES INC., Taoyuan (TW)

(72) Inventors: Chengxing Cai, Taoyuan (TW); Weiting Deng, Taoyuan (TW)

(73) Assignee: ASIAN POWER DEVICES INC., Taoyuan (TW)

( * ) Notice: Subject to any disclaimer, the term of this patent is extended or adjusted under 35 U.S.C. 154(b) by 0 days.

(21) Appl. No.: 15/163,690

(22) Filed: May 25, 2016

(30) Foreign Application Priority Data

Feb. 22, 2016 (TW) ..... 105105232 A

(51) Int. Cl.

| | |
|---|---|
| ***H01R 29/00*** | (2006.01) |
| ***H01R 31/06*** | (2006.01) |
| ***H01R 13/627*** | (2006.01) |
| *H01R 27/00* | (2006.01) |
| *H01R 24/66* | (2011.01) |

(52) U.S. Cl.
CPC ..... *H01R 31/06* (2013.01); *H01R 13/6272* (2013.01); *H01R 24/66* (2013.01); *H01R 27/00* (2013.01)

(58) Field of Classification Search
None
See application file for complete search history.

(56) References Cited

U.S. PATENT DOCUMENTS

| | | | | |
|---|---|---|---|---|
| 6,312,271 | B1 * | 11/2001 | Tseng | H01R 13/44 439/131 |
| 6,544,051 | B1 * | 4/2003 | Su | H01R 35/04 363/146 |
| 7,179,105 | B1 * | 2/2007 | Hung | H01R 13/6675 439/172 |
| 2012/0329316 | A1 * | 12/2012 | Wu | H01R 13/6315 439/518 |

* cited by examiner

*Primary Examiner* — Tho D Ta
(74) *Attorney, Agent, or Firm* — Chieh-Mei Wang

(57) ABSTRACT

A power adapter with replaceable plug structure includes a plug and a housing. The plug includes a contact point. The housing includes an assembly member configured for detachably engaging the plug. The housing includes a left cover, a right cover and an assembly plate. When the left cover and the right cover are assembled, the assembly plate is disposed between the left cover and the right cover. One or more slots are disposed on the assembly plate to form a resilient area. The resilient area includes an electrical conductor. The electrical conductor is in contact with the contact point when the plug is assembled onto the housing.

4 Claims, 8 Drawing Sheets

POWER ADAPTER WITH REPLACEABLE PLUG STRUCTURE

FIELD OF THE INVENTION

The invention relates to a power adapter structure, and more particularly to a power adapter with replaceable plug structure.

BACKGROUND OF THE INVENTION

Most of electronic products, such as medium- and small-sized home appliances, employ an external power adapter for supplying power. Specifically, the power adapter is plugged into the power socket via an input plug, and an output plug of the power adapter is inserted into the socket of an electronic product. The electric current reaches the electronic product by flowing through the input plug, the power adapter and the output plug, so that the electronic product can be activated.

However, specifications of AC power sockets and plugs are not unified around the world, and power supply systems are not standardized either. When a user travels abroad with electronic products of different specifications, the user may not be able to insert the AC power plugs of their electronic products into the local AC power sockets on the wall.

Therefore, power adapters compatible with multiple international standards have developed. Nevertheless, the power adapters often have complicated structures and are vulnerable to malfunction.

Therefore, in view of the aforementioned drawbacks of the prior art, inventors of the present invention provide a solution for solving the problems in the prior art.

SUMMARY OF THE INVENTION

In order to accomplish the above-mentioned objective, the present invention provides a power adapter with replaceable plug structure, which includes a plug and a housing. The plug includes a contact point. The housing includes an assembly member configured for detachably engaging the plug. The housing includes a left cover, a right cover and an assembly plate. When the left cover and the right cover are assembled, the assembly plate is disposed between the left cover and the right cover. One or more slots are disposed on the assembly plate to form a resilient area. The resilient area includes an electrical conductor. The electrical conductor is in contact with the contact point when the plug is assembled onto the housing.

According to the embodiments of the present invention, the replaceable plug structure of the power adapter utilizes the one or more slots to form the resilient area on the assembly plate. Therefore, when the plug is assembled onto the housing, the electrical conductor is pressed to contact the contact point of the plug 10, causing the resilient area to bend and deform. Nevertheless, the resilience of the resilient area allows the electrical conductor to fully contact the contact point, therefore ensuring a steady electrical connection therebetween.

BRIEF DESCRIPTION OF THE DRAWINGS

The invention will become more readily apparent to those ordinarily skilled in the art after reviewing the following detailed description and accompanying drawings, in which.

DETAILED DESCRIPTION OF PREFERRED EMBODIMENTS

Figure 1:
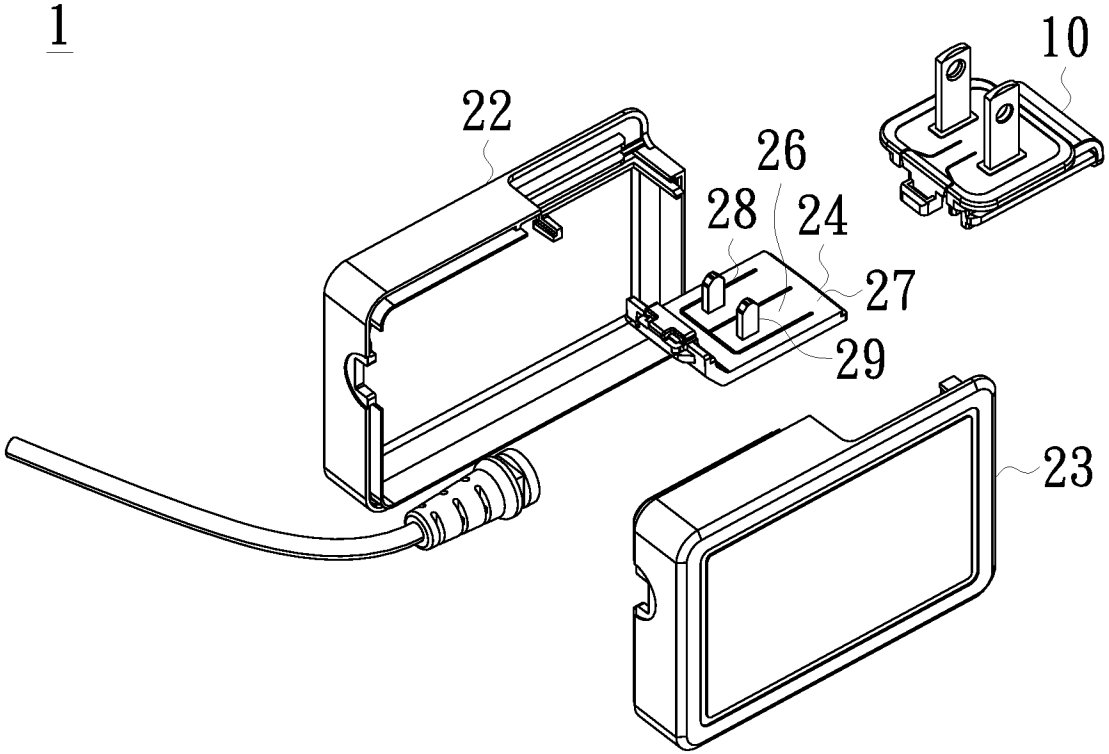
FIG. 1 is an exploded view of a power adapter with replaceable plug structure according to an embodiment of the present invention.
Figure 2:
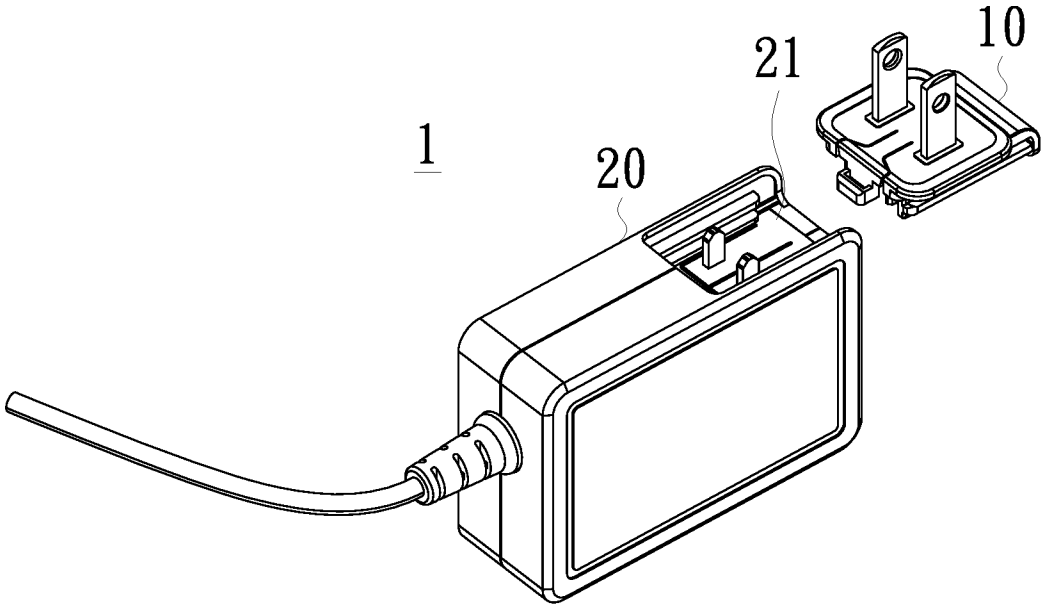
FIG. 2 is a schematic illustration depicting the disassembly of a plug and a housing of the power adapter with replaceable plug structure according to the embodiment of the present invention.
Figure 3:
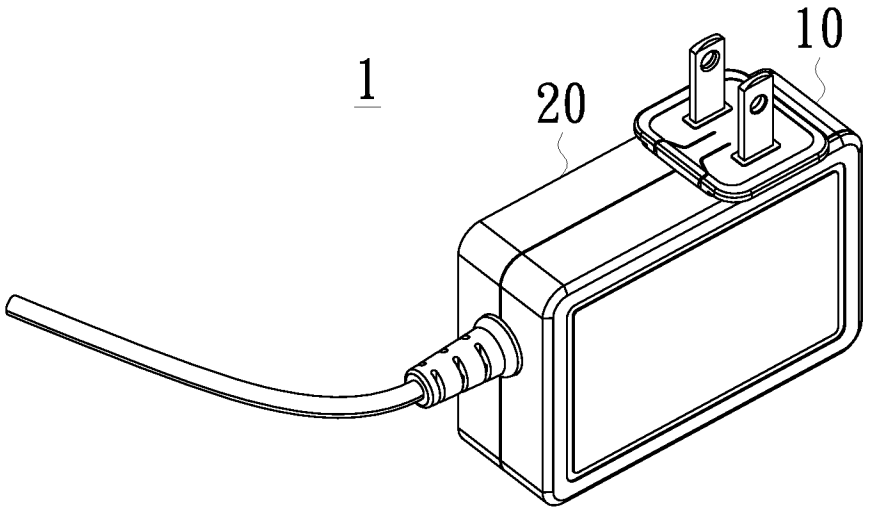
FIG. 3 is a schematic illustration depicting the assembly of the plug and the housing of the power adapter with replaceable plug structure according to the embodiment of the present invention.
Figure 4:
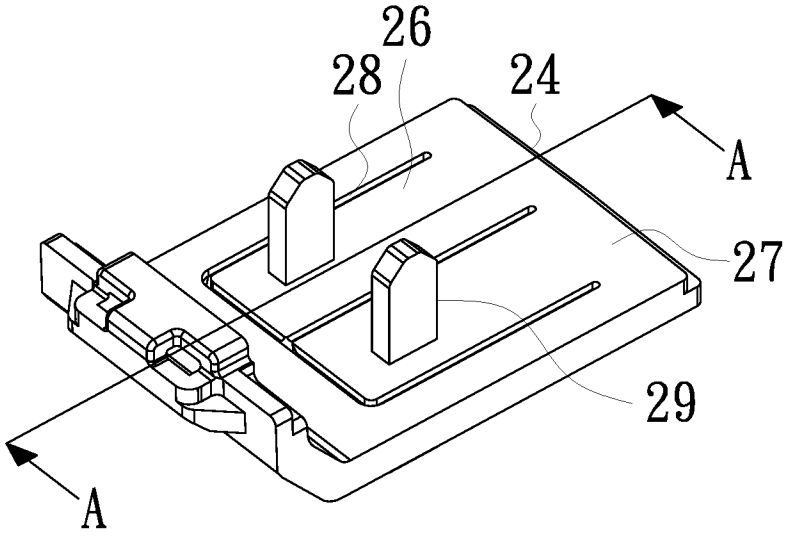
FIG. 4 is a three-dimensional schematic illustration of an assembly plate according to the embodiment of the present invention.

The present invention will now be described more specifically with reference to the following embodiments. It is to be noted that the following descriptions of preferred embodiments of this invention are presented herein for purpose of illustration and description only. It is not intended to be exhaustive or to be limited to the precise form disclosed.

Referring now to FIGS. 1-4, in which a power adapter with replaceable plug structure according to a preferred embodiment of the invention is schematically illustrated. The power adapter 1 includes a plug 10 and a housing 20. The housing 20 includes an assembly member 21 configured for detachably engaging the plug 10. The interior of the housing 20 is hollow and may accommodate a circuit board (not shown in figures). Details on the assembly and disassembly of the plug 10 with the housing 20 are not provided herein as they are not considered the primary focus of the present invention.

A contact point (not shown in figures) is disposed at the back of the plug 10. The housing 20 includes a left cover 22, a right cover 23 and an assembly plate 24. When the left cover 22 and the right cover 23 are assembled, the assembly plate 24 is disposed between the left cover 22 and the right cover 23 and exposed at the assembly member 21. The assembly plate 24 includes a resilient area 26 and a sustaining area 27. One or more slots 28 are disposed on the assembly plate 24 to form the resilient area 26. The resilient area 26 may be, but is not limited to, a resilient plate. The sustaining area 27 is formed between the resilient area 26 and the assembly plate 24. The resilient area 26 includes an electrical conductor 29. When the plug 10 is assembled onto the housing 20, the electrical conductor 29 is pressed to contact the contact point, causing deformation of the resilient area 26 of the assembly plate 24. On the contrary, when the plug 10 is disassembled from the housing 20, the electrical conductor 29 is free of external pressure, and resilience of the resilient area 26 of the assembly plate 24 would thus recover the resilient area 26 back to its original state.

Figure 5:
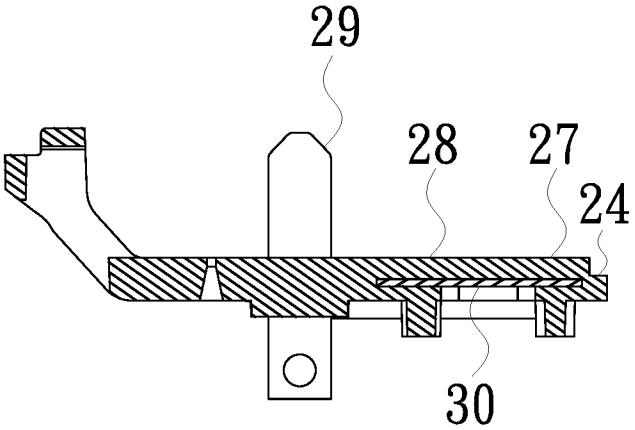
FIG. 5 is a cross-sectional view of the assembly plate of FIG. 4 along line A-A.
Figure 6:
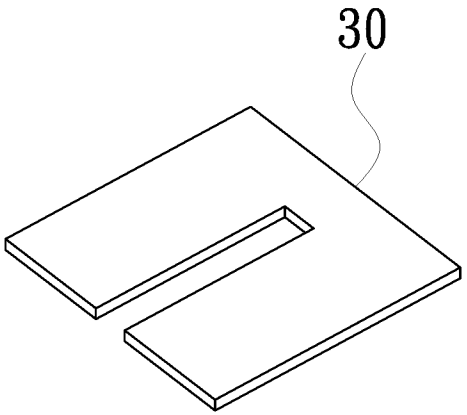
FIG. 6 is a three-dimensional schematic illustration of a metal plate according to the embodiment of the present invention.

Referring now to FIGS. 5 and 6. A metal plate 30 is embedded within the assembly plate 24. In the present embodiment, the metal plate 30 is U-shaped; however, the shape of the metal plate is not limited thereto. Two terminal portions of the metal plate 30 are disposed at the resilient area 26 for enhancing the resilience of the resilient area 26. Besides the terminal portions, the remaining portion of the metal plate 30 is disposed at the sustaining area 27 for supporting the two terminal portions and thus ensuring the resilience of the terminal portions. As such, the resilient area 26 would exert a more steady resilience, and therefore elastic fatigue or fracture of the resilient area can be prevented.

Figure 7:
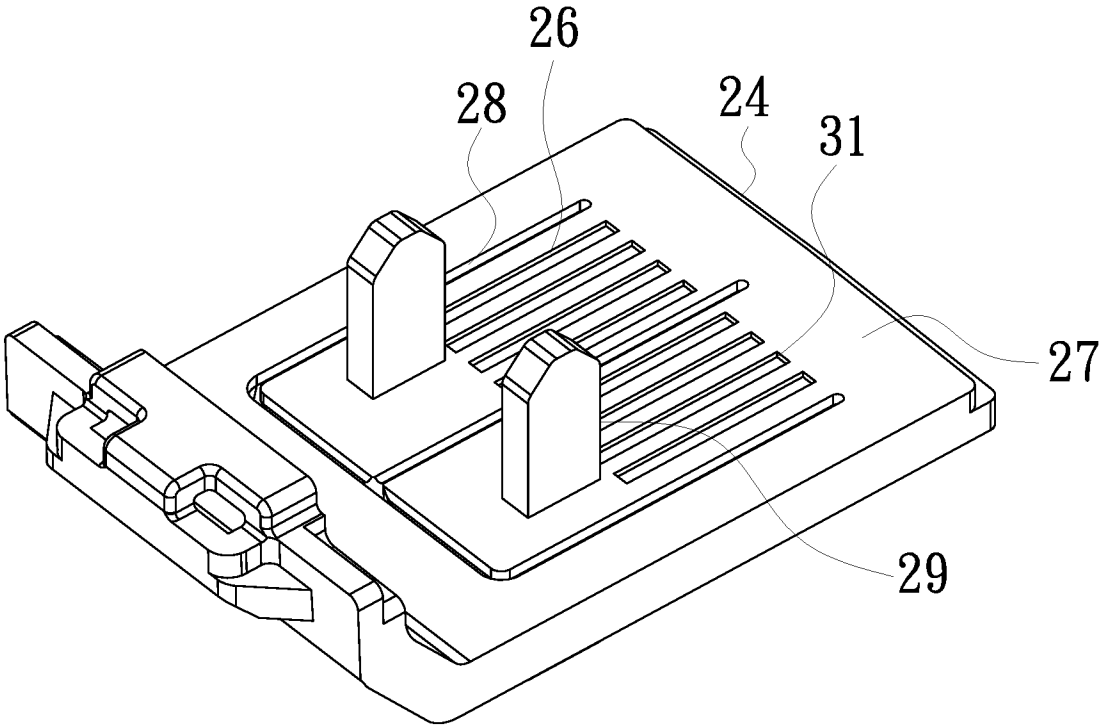
FIG. 7 is a three-dimensional schematic illustration of an assembly plate according to another embodiment of the present invention.

Referring now to FIG. 7. One or more trenches 31 are formed on the resilient area 26 of the assembly plate 24 for enhancing the stiffness of the resilient area 26 and thus preventing fatigue of the resilient area 26 due to poor material quality.

Figure 8:
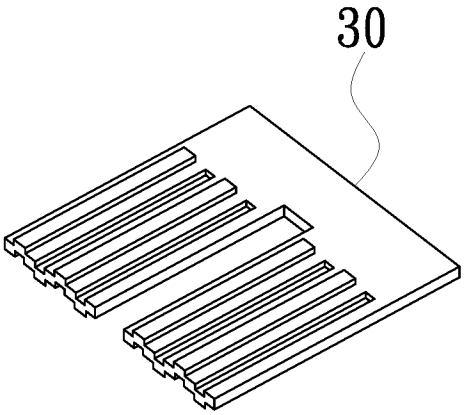
FIG. 8 is a three-dimensional schematic illustration of a metal plate according to yet another embodiment of the present invention.

Referring now to FIG. 8. The metal plate 30 at the resilient area 26 has a ragged surface pattern. In the present embodiment, the surface of the metal plate 30 is formed by a plurality of longitudinal grooves; however, the present invention is not limited thereto. The ragged surface is adapted for increasing the stiffness of the resilient area 26 of the metal plate 30 when flexible materials are used.

In sum, according to the aforementioned embodiments of the present invention, the replaceable plug structure of the power adapter utilizes the one or more slots to form the resilient area on the assembly plate. Therefore, when the plug is assembled onto the housing, the electrical conductor is pressed to contact the contact point of the plug, causing the resilient area to bend and deform. Nevertheless, the resilience of the resilient area 26 allows the electrical conductor 29 to fully contact the contact point, therefore ensuring a steady electrical connection therebetween.

While the disclosure has been described in terms of what is presently considered the most practical and preferred embodiments, it is to be understood that the disclosure needs not be limited to the disclosed embodiment. On the contrary, it is intended to cover various modifications and similar arrangements included within the spirit and scope of the appended claims which are to be accorded with the broadest interpretation so as to encompass all such modifications and similar structures.

What is claimed is:

1. A power adapter with replaceable plug structure, comprising:

a plug, comprising a contact point; and a housing, comprising an assembly member configured for detachably engaging the plug, the housing comprising a left cover, a right cover and an assembly plate, wherein the assembly plate is disposed between the left cover and the right cover when the left cover and the right cover are assembled, one or more slots are disposed on the assembly plate to form a resilient area, a sustaining area is formed between the resilient area and the assembly plate, the resilient area comprises an electrical conductor, the electrical conductor is in contact with the contact point when the plug is assembled onto the housing, wherein the assembly plate further comprises a metal plate embedded therein, and a portion of the metal plate is disposed at the resilient area, and another portion of the metal plate is disposed at the sustaining area.

2. The power adapter with replaceable plug structure according to claim 1, wherein a surface of the metal plate at the resilient area comprises a ragged pattern.

3. The power adapter with replaceable plug structure according to claim 1, wherein a surface of the resilient area comprises a trench.

4. The power adapter with replaceable plug structure according to claim 3, wherein a surface of the metal plate at the resilient area comprises a ragged pattern.

* * * * *